US005766065A

United States Patent [19]

Hasegawa et al.

[11] Patent Number: 5,766,065

[45] Date of Patent: Jun. 16, 1998

[54] APPARATUS FOR POLISHING PERIPHERAL PORTION OF WAFER

[75] Inventors: Fumihiko Hasegawa; Yasuyoshi Kuroda, both of Nishi-shirakawa-gun; Koichiro Ichikawa; Yasuo Inada, both of Nagano, all of Japan

[73] Assignees: Shin-Etsu Handotai Co., Ltd., Tokyo; Fujikoshi Machinery Corp., Nagano, both of Japan

[21] Appl. No.: 567,162

[22] Filed: Dec. 5, 1995

[30] Foreign Application Priority Data

Dec. 13, 1994 [JP] Japan ..... 6-332682

[51] Int. Cl.[6] ..... B24B 5/00

[52] U.S. Cl. ..... 451/173; 451/43

[58] Field of Search ..... 451/173, 43, 44, 451/163, 168, 239, 240, 41, 42, 364, 297, 306, 307

[56] References Cited

U.S. PATENT DOCUMENTS

| | | | |
|---|---|---|---|
| 2,209,538 | 7/1940 | Rabe | 451/239 |
| 3,753,321 | 8/1973 | David | 451/239 |
| 4,796,387 | 1/1989 | Johnson | 451/168 |
| 5,144,772 | 9/1992 | Kawamata et al. | 451/14 |
| 5,398,460 | 3/1995 | Joncour | 451/240 |
| 5,476,413 | 12/1995 | Hasegawa et al. | 451/168 |
| 5,509,850 | 4/1996 | Morioka et al. | 451/173 |

FOREIGN PATENT DOCUMENTS

| | | |
|---|---|---|
| 0515036 | 11/1992 | European Pat. Off. . |
| 0646436 | 4/1995 | European Pat. Off. . |
| 2-303759 | 12/1990 | Japan . |

*Primary Examiner*—Timothy V. Eley
*Assistant Examiner*—Derris H. Banks
*Attorney, Agent, or Firm*—Oliff & Berridge, PLC

[57] ABSTRACT

A polishing apparatus of a peripheral chamfered portion of a semiconductor wafer is disclosed. The polishing apparatus comprises: a rotary drum around the periphery of which a tape having an abrasive layer thereon is wound; a first motor for rotating the rotary drum; a wafer holding mechanism which comprises a wafer holding member for holding a wafer, a second motor for rotating the wafer holding member, a supporting member for supporting the wafer holding member and the second motor, and a wafer inclining member for changing the tilt angle of the wafer with respect to the rotary drum by reciprocally rotating the supporting member on a first axis which is substantially parallel with the main surface of the wafer; and a moving member for bringing the wafer held on the supporting member into contact with or separating it from the tape wound around the rotary drum.

3 Claims, 9 Drawing Sheets

APPARATUS FOR POLISHING PERIPHERAL PORTION OF WAFER

BACKGROUND OF THE INVENTION

1. Field of the Invention

The present invention relates to a polishing apparatus, in particular, to a polishing apparatus for polishing a peripheral chamfered portion of a semiconductor wafer.

2. Description of Related Art

As a polishing apparatus for polishing a peripheral chamfered portion of a semiconductor wafer such as a silicon single crystal wafer, a compound semiconductor wafer or the like (hereinafter, simply referred to a wafer), a polishing apparatus shown in FIG. 9 has been known.

Such a polishing apparatus 10 comprises a rotatable wafer holding member 30 for holding a wafer W rotated by a motor or the like, a pushing member 20 for pushing a tape T on the surface of which abrasive are adhered, against the peripheral chamfered portion of the wafer W to be polished, a supply reel 25 for supplying the tape T with abrasive, and a take-up reel 28 for taking up the used portion of the tape T. In the conventional polishing apparatus 10, the tape T drawn out of the supply reel 25 is pushed against the peripheral chamfered portion of the wafer W by the pushing member 20 and is transferred in a direction approximately perpendicular to the main surface of the wafer W to polish the peripheral chamfered portion of the wafer W by always using fresh surface portion of the tape T. The used portion of the tape T are taken up by the take-up reel 28 continuously. During polishing, the tape T is swung in a small range in a width direction thereof and the wafer W held by the wafer holding member 30 is rotated. In the conventional polishing apparatus 10, the swing of the tape and the rotation of the wafer W give a relative speed of the peripheral chamfered portion of the wafer W to the tape T.

In a polishing treatment using a tape T, the fresh surface take-up speed of the tape T and the relative speed between the peripheral chamfered portion of the wafer W and the tape T in the polishing area are important elements to perform a good polishing. However, in the conventional polishing apparatus 10, although the take-up speed of the tape T can be freely changed and therefore the fresh surface drawing speed of the tape T can be also freely changed, it is difficult to obtain sufficient relative speed between the peripheral chamfered portion of the wafer W and the tape T in the polishing area. Further, because the surface portions of the tape T near both sides is used on only the small swinging thereof, it is difficult to effectively use the whole surface of the tape T. In order to obtain a sufficient relative speed, it is necessary to rotate the wafer W at a high speed. However, according to such a high speed rotation, there are some fear for generation of vibration of the wafer W caused by eccentricity of the wafer to the rotary axis thereof and some fear for excessive polishing of the edge of the orientation flat portion of the wafer W.

SUMMARY OF THE INVENTION

The present invention was developed in view of the above-described problems. An object of the present invention is to provide a polishing apparatus for polishing a peripheral chamfered portion of a semiconductor wafer, by which a good polishing can be stably performed. Another object of the present invention is to provide a polishing apparatus for polishing a peripheral chamfered portion of a semiconductor wafer, in which the tape thereof can be uniformly used for polishing also the peripheral chamfered portion of a wafer having an orientation flat.

In accordance with one aspect of the present invention, the polishing apparatus of a peripheral portion of a semiconductor wafer comprises: a rotary drum around the periphery of which a tape having an abrasive layer thereon is wound, and which is rotated by a first motor; a wafer holding mechanism which comprises a wafer holding member for holding a wafer, a second motor for rotating the wafer holding member, a supporting member for supporting the wafer holding member and the second motor, and a wafer inclining member for changing the tilt angle of the wafer with respect to the rotary drum by reciprocally rotating the supporting member on a first axis which is substantially parallel with the main surface of the wafer; and a moving member for bringing the wafer held on the supporting member into contact with or separating it from the tape wound around the rotary drum.

According to the above described apparatus, the peripheral portion of the wafer is pressed against the tape by moving the wafer held on the supporting member toward the tape by using the moving member. The tilt angle of the wafer with respect to the rotary drum is changed by reciprocally rotating the supporting member on the axis for inclination by using the wafer inclining member. Thereby, it is possible to polish all over the peripheral chamfered portion on the upper and lower surfaces of the wafer.

Preferably, the wafer holding member comprises a wafer suction disc for sucking to support a wafer. The rotary drum preferably comprises a cylindrical body having a pair of slits for tape formed therein, a tape supplying reel provided inside the cylindrical body, for supplying the tape which is wound therearound, and a take-up reel provided inside the cylindrical body, for taking-up the tape, and the cylindrical body, the tape supplying reel and the take-up reel are disposed in substantially coaxial, and the tape from the tape supplying reel is spirally wound around the outside periphery of the rotary drum through one of the slits and is wound around the take-up reel through the other of the slits. The cylindrical body preferably comprises upper and lower cylindrical body members, and one of the upper and lower cylindrical body members can be rotated by the first motor and the other of the cylindrical body members has the take-up reel inside which is rotatable by a third motor.

Accordingly, it is possible to supply fresh surfaces of the tape continuously and to obtain a sufficient relative speed of the peripheral chamfered portion of the wafer with respect to the tape by the rotation of the rotary drum. Therefore, it is possible to stably perform an excellent polishing.

Preferably, the wafer inclining member comprises a first turning member for reciprocally rotating the supporting member on the central axis thereof to change the tilt angle of the supporting member with respect to the rotary axis of the rotary drum. The first turning member may comprise a worm which is reciprocally rotated by a motor, and a worm wheel which is rotated on the central axis by the worm and is fixed to the supporting member. Preferably, the moving member is for reciprocally rotating the supporting member on a second axis which is substantially parallel with the rotary axis of the rotary drum, to bring the wafer held on the wafer holding member into contact with or to separate it from the tape wound around the rotary drum. The moving member may comprise a cylinder device for pushing an end portion of the wafer holding mechanism. Accordingly, it is possible to keep the contact pressure in pushing the pushing plate constant by keeping the pressure in the cylinder constant, and thereby it is possible to perform good polishing.

In accordance with another aspect of the present invention, the polishing apparatus of a peripheral portion of a semiconductor wafer comprises: a rotary drum around the periphery of which a tape having an abrasive layer thereon is wound, and which is rotated by a first motor; a wafer holding mechanism which comprises a wafer holding member for holding a wafer, a second motor for rotating the wafer holding member, a supporting member for supporting the wafer holding member and the second motor, a wafer inclining member for changing the tilt angle of the wafer with respect to the rotary drum by reciprocally rotating the supporting member on a first axis which is substantially parallel with the main surface of the wafer, and a holding member moving mechanism for moving the wafer holding member on the supporting member so that the peripheral portion of the wafer and a portion of the tape to be brought into contact with the peripheral portion of the wafer are always on or near a predetermined line; and a moving member for bringing the wafer held on the supporting member into contact with or separating it from the tape wound around the rotary drum.

According to the apparatus having the above structure, because the wafer can be moved so that the peripheral portion of the wafer is on or near the axis for inclination, by the holding member moving mechanism, even the contact point of the wafer having an orientation flat portion and the tape is not different from that of the other peripheral portion of the wafer and the tape, on the periphery of the rotary drum in the direction of the axis. Therefore, the tape can be uniformly utilized, so that the peripheral portion including the orientation flat of the wafer is effectively polished.

The predetermined line may be on the first axis. Preferably, the holding member moving mechanism comprises a primary arm, a secondary arm having the wafer holding member, which is attached to the primary arm so as to be rotatable on a pivot, a cam driver rotating according to the rotation of the wafer holding member, which is provided on the secondary arm, a cam follower engaging the cam driver, which is provided on the secondary arm, and a pressing member for pressing the cam driver against the cam follower, so that the peripheral portion of the wafer faced to the tape is on or near the predetermined line irrespective of the figure of the faced peripheral portion of the wafer. Preferably, the cam driver has a similar figure to that of the wafer in plan. The pressing member may comprise a spring.

Accordingly, when the distance between the center of the wafer and the contact portion of the wafer and a portion of the tape is changed, the primary arm is not moved, but the secondary arm is moved to smoothly move the wafer holding member. Therefore, it is possible to make the change of the contact pressure of the contact portion of the wafer and the tape small. Because the peripheral portion of the wafer and the tape are always on or near the axis for inclination while the wafer holding member is rotated, when the wafer is inclined and even when the contact portion is on the orientation flat portion, the tape can be uniformly utilized.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENT OF THE INVENTION

Next, embodiments of the polishing apparatus of a peripheral portion of a wafer according to the present invention will be explained with reference to the drawings.

Figure 1:
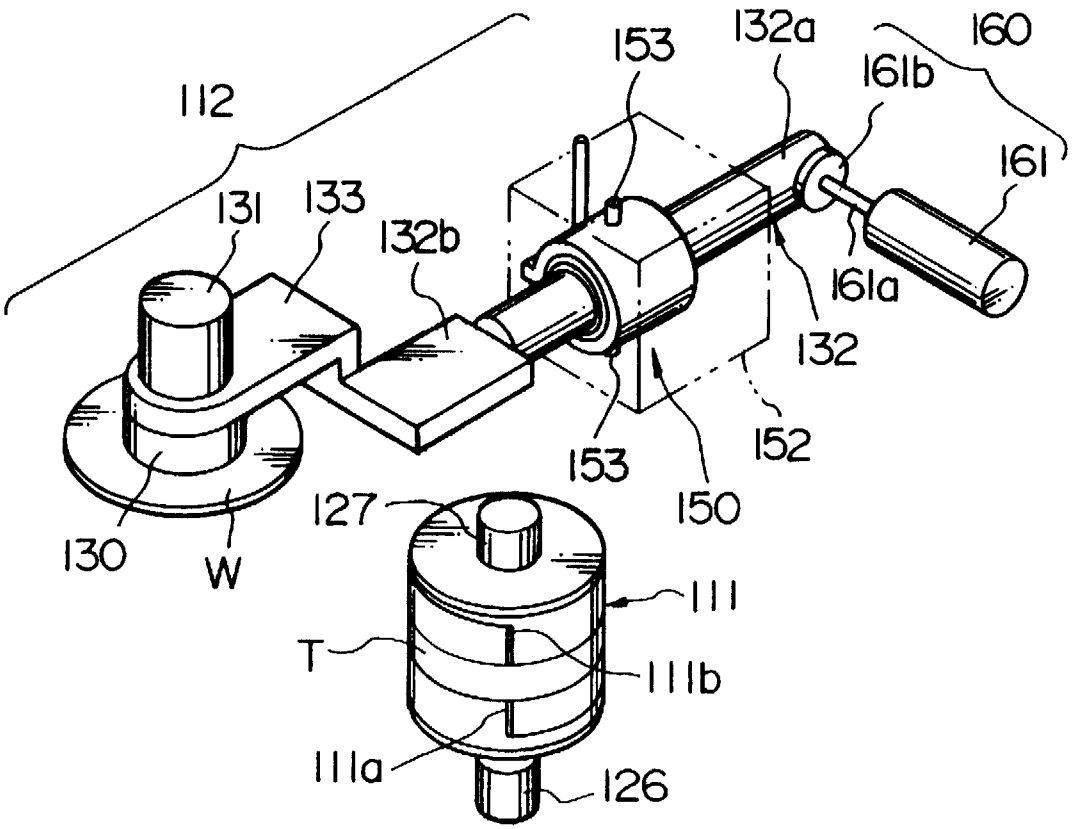
FIG. 1 is an external appearance perspective view of the polishing apparatus according to the first embodiment of the present invention.

FIG. 1 is an external appearance perspective view of the polishing apparatus of a peripheral portion of a wafer according to the first embodiment of the present invention. The polishing apparatus 110 comprises a rotary drum 111 around the periphery of which a tape T is spirally wound, and which is rotated by a first motor 126; a wafer holding mechanism 112 for holding a wafer W having a peripheral chamfered portion to be polished; and a moving member 160 for moving the wafer holding mechanism 112.

Figure 2:
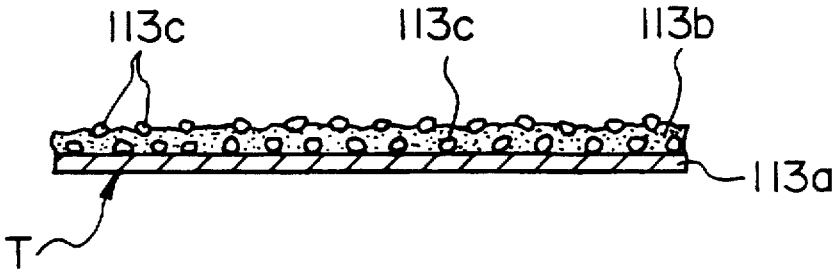
FIG. 2 is a schematic vertical-sectional view showing the construction tape according to the embodiment.

The tape T comprises a tape base member 113*a*, and abrasive grains 113*c* are adhered on the tape base member 113*a* through adhesives 113*b*, as shown in FIG. 2. As a tape T, it is also possible to use one in which a coating containing abrasive grains is coated on the tape base member, although it is not shown in Figures.

Figure 3:
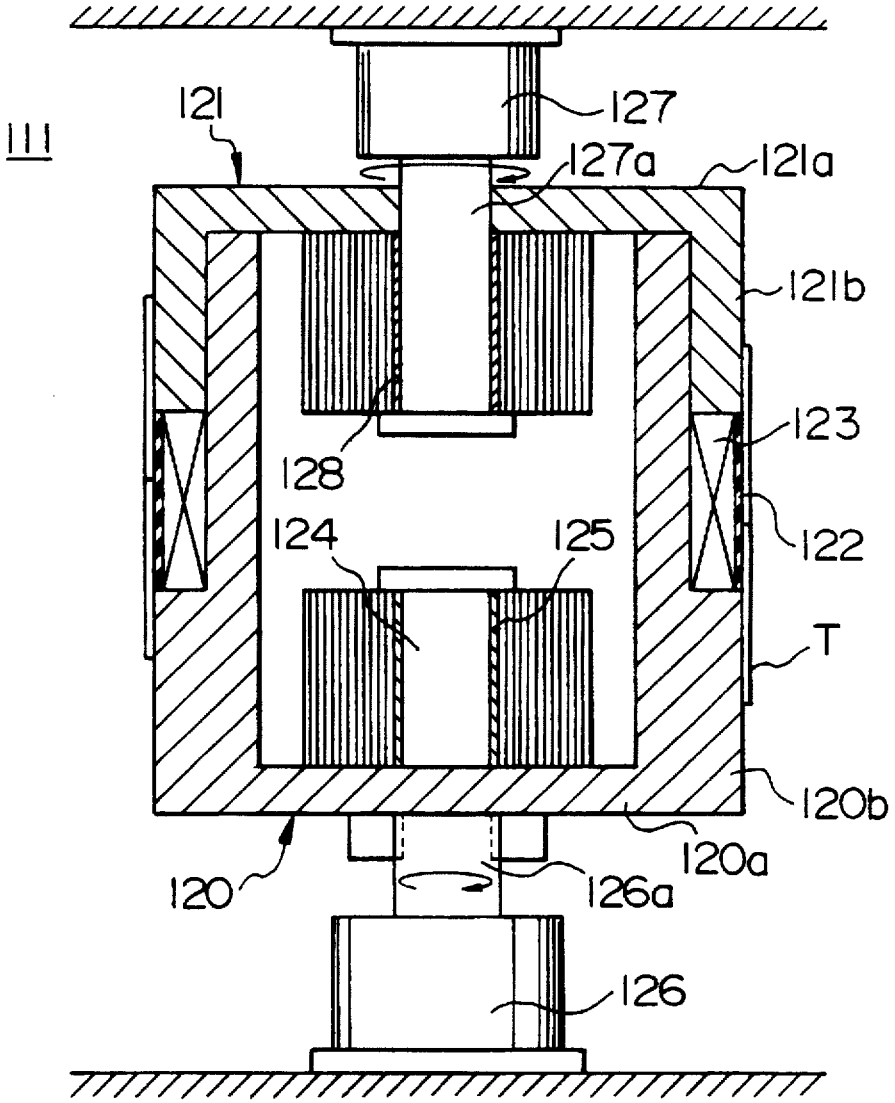
FIG. 3 is a vertical sectional view for explaining the construction the rotary drum according to the embodiment.

The rotary drum 111 comprises a lower cylindrical body 120 having a bottom plate 120*a*, and an upper cylindrical body 121 having a ceiling plate 121*a*, as shown in FIG. 3. A circumferential step is formed in the peripheral wall 120*b* of the lower cylindrical body 120. That is, the peripheral wall 120*b* of the lower cylindrical body 120 comprises a lower portion having a larger diameter and an upper portion having a smaller diameter. The upper portion having a smaller diameter of the lower cylindrical body 120 can be tightly interfitted in the upper cylindrical body 121. On the bottom plate 120*a* of the lower cylindrical body 120, a reel supporting shaft 124 is erected. On the reel supporting shaft 124, a tape supplying reel 125 around the periphery of which the tape T is wound so that the adhered surface of abrasive grains 113*c* faces to outside, is provided. The tape supplying reel 125 can be idled on the reel supporting shaft 124, and the installation and removal thereof from the reel supporting shaft is permitted. The bottom plate 120*a* of the lower cylindrical body 120 is fixed to a motor shaft (rotary shaft) 126*a* of a first motor 126. On the other hand, a third motor 127 is provided above the upper cylindrical body 121, and a motor shaft 127*a* of the third motor 127 passes through the ceiling plate 121*a* of the upper cylindrical body 121 to enter the inside of the upper cylindrical body 121. The motor shaft 127*a* constitutes a reel supporting shaft, and a take-up reel 128 is fixed to the portion of the motor shaft 127*a* in the inside of the upper cylindrical body 121. In the circumferential wall of the rotary drum 111, a pair of slits for tape 111*a* and 111*b* are formed. The tape T supplied from the tape supplying reel 125 is once introduced to the outside of the rotary drum 111 through the slit 111*a* for tape and is wound around the rotary drum 111, and then is introduced to the inside of the rotary drum 111 again through the slit 111*b* for tape and is wound around the take-up reel 128.

The wafer holding mechanism 112 comprises a wafer suction disc (a wafer holding member) 130 for sucking to support a wafer W, a second motor 131 for rotating the wafer suction disc 130 and the wafer W sucked by the disc 130, and a primary arm (supporting member) 132 for supporting the wafer suction disc 130 and the second motor 131. The primary arm 132 comprises an arm base portion 132*a* having a circular shaped section and an arm front end portion 132*b* having a rectangular shaped section.

A secondary arm 133 having a rectangular shaped section is attached to the primary arm 132. The secondary arm 133 is fixed to the arm front end portion 132*b*. The wafer suction disc 130 is provided on the lower surface of the secondary arm 133, and the second motor 131 having a column shape is provided on the upper surface of the secondary arm 133. In the wafer holding mechanism 112, the wafer suction disc 130, the secondary arm 133 and the like are arranged so that when a wafer W is held on the lower surface of the wafer suction disc 130, the periphery of the wafer W comes into contact with the central axis of the primary arm 132.

Figure 4:
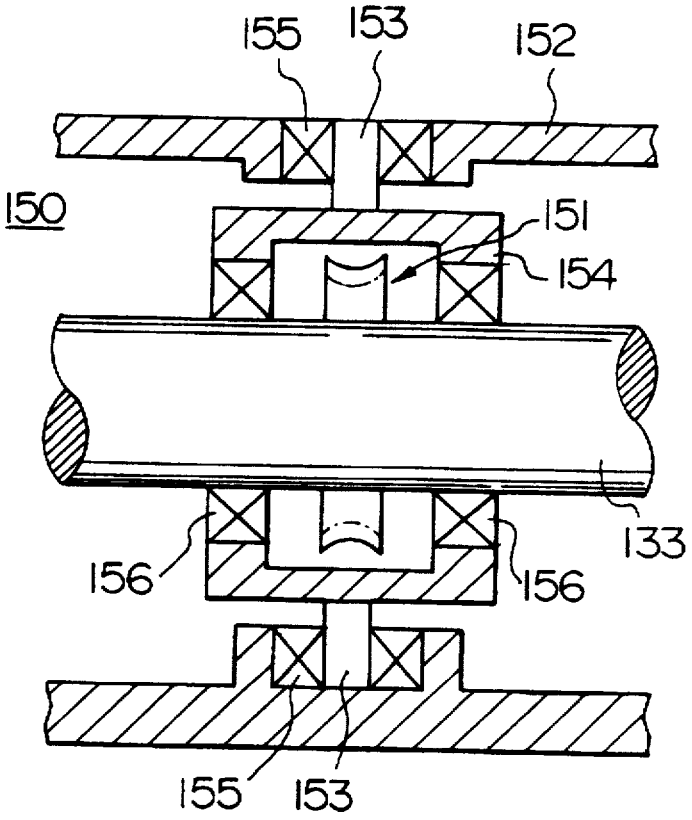
FIG. 4 is a vertical sectional left side view showing the wafer inclining member according to the embodiment.
Figure 5:
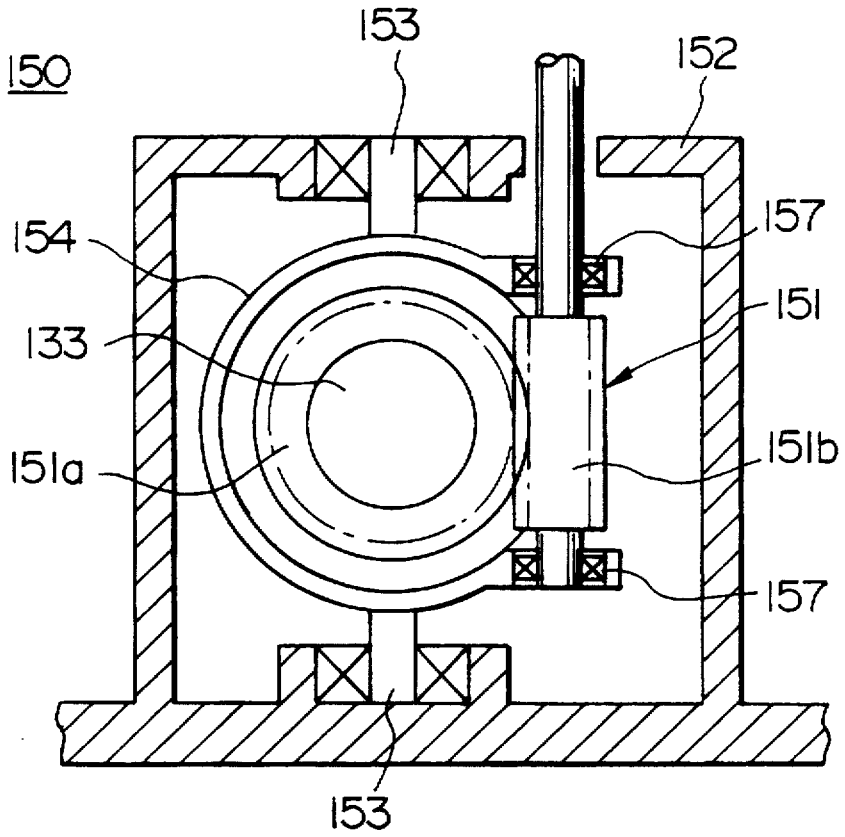
FIG. 5 is a vertical sectional rear view showing the wafer inclining member according to the embodiment.

On the other hand, a wafer inclining member 150 is connected with the primary arm 132. The wafer inclining member 150 comprises a worm gearing 151, and a motor (not shown) for driving the worm gearing 151, which can be reciprocally rotated, as shown in FIGS. 4 and 5. The worm gearing 151 is contained in a mechanical box 152. A hand drum shaped worm wheel 151*a* constituting the worm gearing 151 is attached and secured to the arm base portion 132*a* of the primary arm 132. The arm base portion 132*a* is supported by a sleeve 154 through bearings 156 and 156. To the periphery of the sleeve 154, turn shafts 153 and 153 which are parallel to the rotary axis of the rotary drum 111 are attached. The turn shafts 153 and 153 are supported by the mechanical box 152 through bearings 155 and 155. A worm 151*b* constituting the worm gearing 151 is attached to the sleeve 154 through bearings 157 and 157, and is connected with a motor which is not shown, through a flexible joint or the like outside the mechanical box 152. Therefore, by controlling the number of rotation of the motor in clockwise and counterclockwise directions, the worm gearing 151 is driven in clockwise and counterclockwise directions. Consequently, the primary arm 132 is reciprocally rotated (turned) through a predetermined angle on the central axis of the arm base portion 132*a* (axis for inclination). On the periphery of the rotary drum 111, a bearing 123 is provided. On the periphery of an outer ring of the bearing 123, a rubber 122 is adhered. The function of the bearing 123 is to perform smoothly the movement of the tape T.

A turning member (moving member) 160 for bringing the wafer holding mechanism 112 in contact with or for separating it from the tape T wound around the rotary drum 111, is coupled to the primary arm 132. The turning member 160 comprises an air cylinder device 161, as shown in FIG. 1. A pushing plate 161*b* is provided on the top end of a rod 161*a* of the air cylinder device 161. The primary arm 132 can be turned on the turn shafts 153 through the pushing plate 161*b*, thereby the peripheral chamfered portion of the wafer W can be into contact with and pressed against the tape T wound around the periphery of the rotary drum 111. In order to insure that the primary arm 132 is coupled with the motion of the rod 161*a*, an energizing member (such as a spring or the like) for always pushing the arm base portion 132*a* of the primary arm 132 against the pushing plate 161*b* is provided at a proper position.

Next, the method of using the polishing apparatus 110 according to the embodiment will be explained, as well as the function of the polishing apparatus 110.

In the lower cylindrical body 120 which is separated from the upper cylindrical body 121, the tape supplying reel 125 around which the tape T is wound, is set. In the upper cylindrical body 121, the take-up reel 128 is set. The top end of the tape T wound around the tape supplying reel 125 is pull out through the slit 111*a* for tape formed in the lower cylindrical body 120 and is wound around the periphery of the rotary drum 111 in helical fashion, and then is wound around the take-up reel 128 through the slit 111*b* of the upper cylindrical body 121.

On the other hand, the wafer W is sucked and supported by the wafer suction member 130 of the wafer holding mechanism 112. The primary arm 132 is turned on the turn shafts 153 and 153 by the air cylinder device 161, so that the peripheral chamfered portion of the wafer W is brought into contact with the tape T wound around the periphery of the rotary drum 111. During the contact, it is preferable to rotate the rotary drum 111 by the first motor 126 and the wafer W by the second motor 131, and to have the tape T take traveling action. Although the rotation direction of the rotary drum 111 and the traveling direction of the tape T are not limited, it is preferable to be the same.

Figure 6:
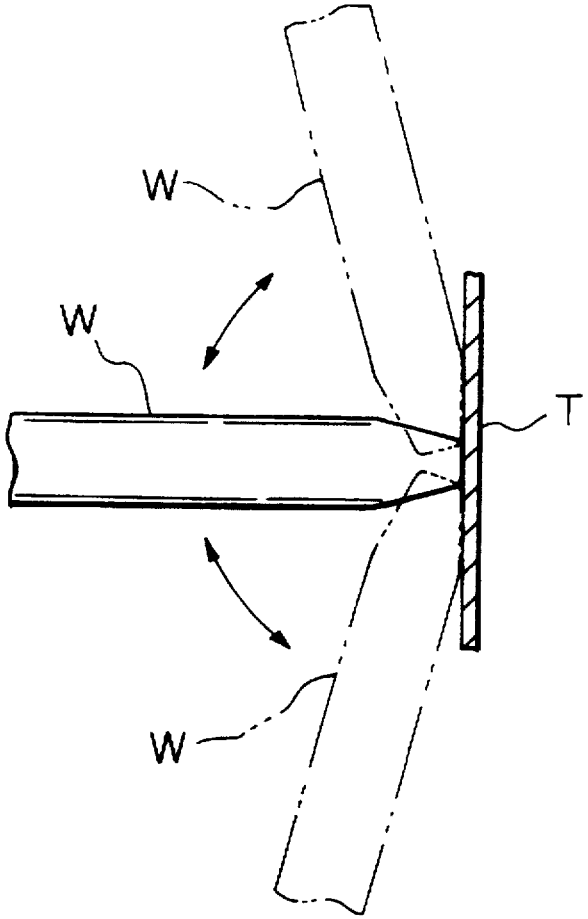
FIG. 6 is a view for explaining the function of the wafer holding mechanism according to the embodiment.

Thus, the polishing is carried out by the tape T brought into contact with the peripheral chamfered portion of the wafer W. In this case, the worm gearing 151 is operated by a motor which is not shown, so that the primary arm 132 is reciprocally rotated through a predetermined angle on the central axis of the arm base portion 132*a*, and thereby the wafer W is inclined with respect to the tape T wound around the periphery of the rotary drum 111, as shown in FIG. 6. The rotary drum 111 is rotated at a relatively high speed by the first motor 126, and the wafer W is rotated by the second motor 131 slowly.

In the polishing apparatus 110 having such a construction, the peripheral chamfered portion of the wafer W is pressed against the tape T by turning the primary arm 132 centered on the turn shafts 153 and 153 by using the turning member (moving member) 160, and the tilt angle of the wafer W can be changed with respect to the rotary drum 111 by reciprocally rotating the primary arm 132 on the axis for inclination through a rotation angle by using the wafer inclining member 150 to operate the wafer W centered on the contact portion of the peripheral portion of the wafer W (including the orientation flat portion) and the tape T. Thereby, it is possible to polish all over the peripheral chamfered portion (including the orientation flat portion) on the upper and lower surfaces of the wafer W. Because the air cylinder device 161 is used as the moving member 160, it is possible to keep the contact pressure in pushing the pushing plate 161*b* constant by keeping the air pressure in the cylinder constant. Therefore, it is possible to make the change of the contact pressure of the contact portion of the wafer W and the tape T small.

The tape T is wound around the rotary drum 111 in helical fashion, and the tape T is moved by the rotation of the take-up reel 128. Therefore, it is possible to supply fresh surfaces of the tape T continuously and to obtain a sufficient relative speed of the peripheral chamfered portion with respect to the tape T by the rotation of the rotary drum 111. Therefore, it is possible to stably perform an excellent polishing.

Figure 7:
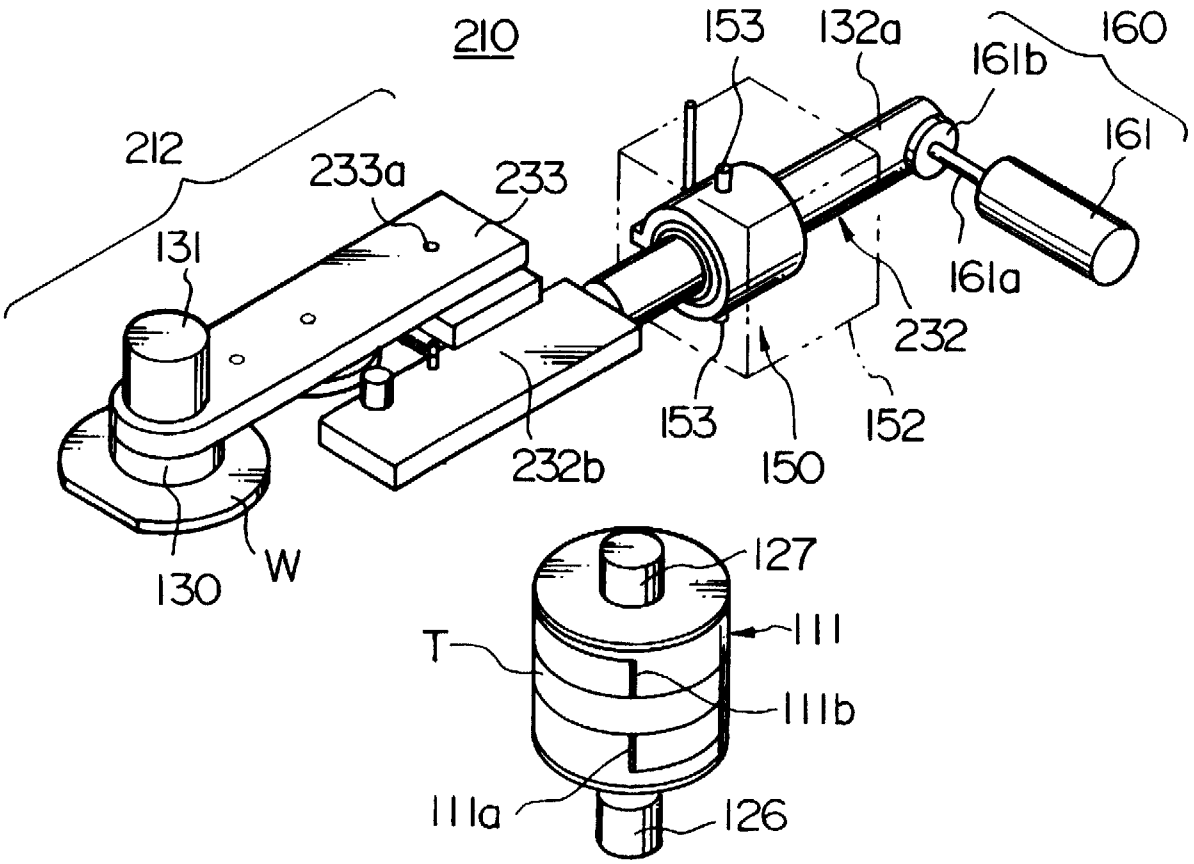
FIG. 7 is an external appearance perspective view of the polishing apparatus according to the second embodiment of the present invention.

FIG. 7 is an external appearance perspective view of the polishing apparatus 210 of a peripheral portion of a wafer according to the second embodiment of the present invention. The polishing apparatus 210 of the second embodiment differs from that of the first embodiment in that a moving mechanism 234 for moving the wafer holding member 130 is provided on the supporting member, in order to always bring the peripheral portion of the wafer W to be polished on a predetermined line substantially, regardless of figure variations of the peripheral portions of the wafer, e.g., even when an orientation flat having a figure which is different from that of another peripheral portion of the wafer W is faced to the rotary drum 111.

Since other structures in this embodiment are approximately the same as those of the first embodiment, a detailed explanation for such structures is omitted. In FIG. 7 showing this embodiment, the same numbers are attached to structural members, elements or the like corresponding to those of the first embodiment.

In the second embodiment, the polishing apparatus 210 comprises a rotary drum 111 around the periphery of which a tape T is wound, and which is rotated by a first motor 126; a wafer holding mechanism 212 for holding a wafer W having a peripheral chamfered portion to be polished; and a moving member 160 for moving the wafer holding mechanism 212.

The wafer holding mechanism 212 comprises a wafer suction disc (wafer holding member) 130 for sucking to support a wafer W, a second motor 131 for rotating the wafer suction disc 130 and the wafer W sucked by the wafer suction disc 130, a primary arm (supporting member) 232 for supporting the wafer suction disc 130 and the second motor 131, a wafer inclining member 150 for changing the tilt angle of the wafer W with respect to the rotary drum 111 by reciprocally rotating the supporting member 232 on a first axis which is substantially parallel with the main surface of the wafer W, and a moving mechanism 234 for moving the wafer suction disc 130 on the supporting member 232. The primary arm 232 comprises an arm base portion 132*a* having a circular shaped section and an arm front end portion 232*b* having a rectangular shaped section.

Figure 8:
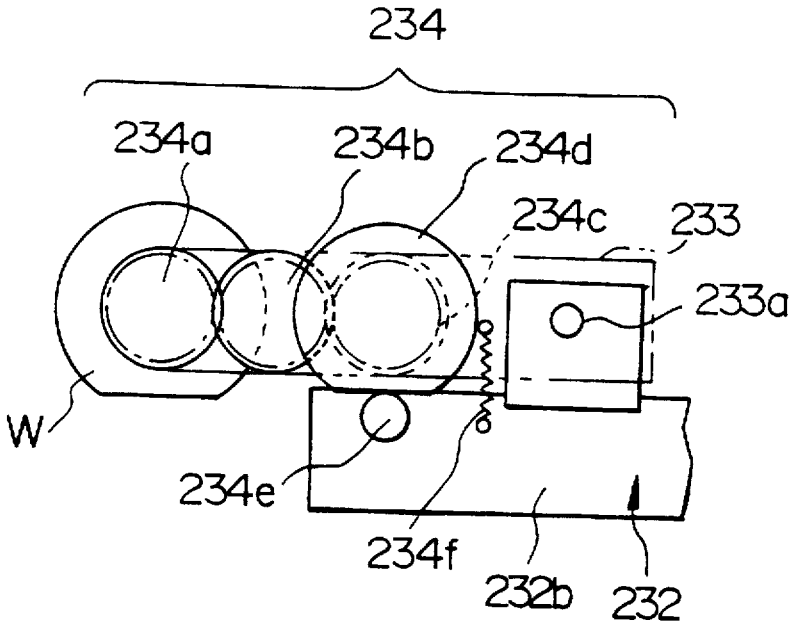
FIG. 8 is a plan view showing the principal part of the wafer holding mechanism according to the second embodiment.
Figure 9:
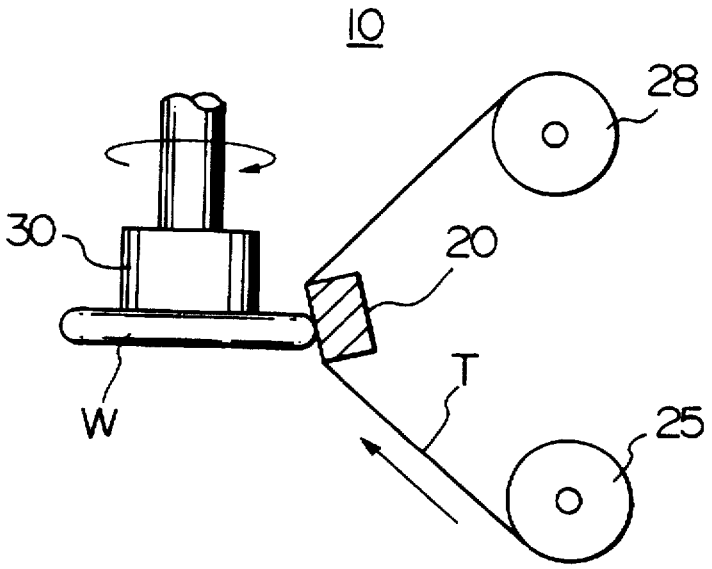
FIG.9(PRIOR ART)
FIG. 9 is a schematic view of an example of a conventional polishing apparatus of a peripheral portion of a wafer.

A secondary arm 233 having a rectangular shaped section is attached to the primary arm (supporting member) 232. The secondary arm 233 is attached to the arm front end portion 232*b* so as to be rotatable on a pivot 233*a* which is perpendicular to a plane including the main surface of the wafer W. The wafer suction disc 130 is provided on the lower surface of the secondary arm 233, and the second motor 131 having a column shape is provided on the upper surface of the secondary arm 233. On the lower surface of the secondary arm 233, a gear 234*a* attached to a motor shaft (not shown) of the motor 131, a gear 234*b* engaging the gear 234*a*, a gear 234*c* engaging the gear 234*b*, and a cam driver 234*d* attached to the gear 234*c* coaxially, are provided, as shown in FIG. 8. On the other hand, on the arm front end portion 232*b*, a cam follower 234*e* engaging the cam driver 234*d* is provided. The secondary arm 233 and the arm front end portion 232*b* are connected through a spring 234*f* so that the cam driver 234*d* is continually pressed against the cam follower 234*e* by the spring 234*f*. The cam driver 234*d* and the cam follower 234*e* constitute a positive motion cam. The secondary arm 233, the gears 234*a*, 234*b* and 234*c*, the cam driver 234*d*, the cam follower 234*e*, and the spring 234*f* constitute the suction disc moving mechanism 234 as a whole. In the suction disc moving mechanism 234, the number of teeth of the gears 234*a* and 234*c* are the same. The cam driver 234*d* has a similar figure to that of the wafer W in plan. In this mechanism 234, the portion of the wafer W corresponding to the portion of the cam driver 234*d* coming into contact with the cam follower 234*e* comes into contact with the tape T on the rotary drum 111.

The contact portions of the peripheral portion of the wafer W, which include the orientation flat, and a portion of the tape T always come to be on or near the axis for inclination, by the action of the wafer holding member moving mechanism 234.

According to the polishing apparatus 210 having such a moving mechanism 234 for moving the wafer holding member 130, when the distance between the center of the wafer W and the contact portion of the wafer W and a portion of the tape T is changed, the primary arm 132 is not moved, but the secondary arm 233 is moved to smoothly move the wafer holding member 130. Therefore, it is possible to make the change of the contact pressure of the contact portion of the wafer and the tape small. Because the peripheral portion of the wafer W and the tape T are always on or near the axis for inclination while the wafer suction member 30 is rotated, when the wafer W is inclined and even when the contact portion is on the orientation flat portion, the tape T can be uniformly utilized.

Although the present invention has been described in its preferred form with a certain degree of particularity, it should also be understood that the present invention is not limited to the preferred embodiments and that various changes and modifications may be made to the invention without departing from the spirit and scope thereof.

For example, in the above-described embodiment, although the air cylinder device 61 is used as the turning member 60, a hydraulic cylinder can be also used.

When the wafer having no orientation flat is polished, the cam driver 34*d* for the wafer having an orientation flat may be removed, and a cam driver corresponding to the wafer having no orientation flat may be attached.

According to the present invention, because the tape with an abrasive layer is wound around the rotary drum which is rotated by a motor, it is possible not only to supply fresh surfaces of the tape continuously but also to obtain a sufficient relative speed of the peripheral chamfered portion with respect to the tape by the rotation of the rotary drum. Therefore, it is possible to stably perform an excellent polishing.

Furthermore, because the tilt angle of the wafer with respect to the rotary drum can be changed, it is possible to polish all over the peripheral chamfered portion on the upper and lower surfaces of the wafer. Because the wafer can be moved so that the peripheral portion of the wafer is on or near the axis for inclination, by the suction disc moving mechanism, even the contact point of the wafer having an orientation flat portion and the tape is not different from that of the other peripheral portion of the wafer and the tape, on the periphery of the rotary drum in the direction of the axis. Therefore, the tape can be uniformly utilized, so that the peripheral portion including the orientation flat of the wafer is effectively polished.

What is claimed is:

1. A polishing apparatus of a peripheral portion of a semiconductor wafer comprising:

a) a rotary drum including a rotary axis and a periphery around which a tape having an abrasive layer thereon is wound, and being rotated by a first motor;

b) a wafer holding mechanism including a wafer holding member for holding a wafer, a second motor for rotating the wafer holding member, a supporting member for supporting the wafer holding member and the second motor, and a wafer inclining member for changing a tilt angle of the wafer with respect to the rotary drum by reciprocally rotating the supporting member on a first axis which is substantially parallel to a main surface of the wafer; and c) a moving member reciprocally rotating the supporting member on a second axis substantially parallel to the rotary axis of the rotary drum, so as to bring the wafer held on the wafer holding member into contact with, or to separate it from, the tape.

2. A polishing apparatus as claimed in claim 1, wherein the moving member comprises a cylinder device for pushing an end portion of the wafer holding mechanism.

3. A polishing apparatus of a peripheral portion of a semiconductor wafer comprising:

a) a rotary drum including a rotary axis and a periphery around which a tape having an abrasive layer thereon is wound, and which is rotated by a first motor;

b) a wafer holding mechanism which comprises a wafer holding member for holding a wafer, a second motor for rotating the wafer holding member, a supporting member for supporting the wafer holding member and the second motor, a wafer inclining member for changing the tilt angle of the wafer with respect to the rotary drum by reciprocally rotating the supporting member on a first axis which is substantially parallel with a main surface of the wafer, and a holding member moving mechanism for moving the wafer holding member on the supporting member so that a peripheral portion of the wafer and a portion of the tape to be brought into contact with the peripheral portion of the wafer are always on, or near, a predetermined line; and c) a moving member reciprocally rotating the supporting member on a second axis which is substantially parallel with the rotary axis of the rotary drum, so as to bring the wafer held on the wafer holding member into contact with, or to separate it from, the tape wound around the rotary drum.

* * * * *